United States Patent [19]

Okura

[11] 4,380,955

[45] Apr. 26, 1983

[54] ROTARY TYPE TAPERED PART TRICHROMATIC PRINTER

[76] Inventor: Tsunehiko Okura, 3692, Oaza Koori, Konan-shi, Aichi-ken, Japan

[21] Appl. No.: 247,315

[22] Filed: Mar. 25, 1981

[30] Foreign Application Priority Data

Dec. 26, 1980 [JP] Japan ..... 55-183933

[51] Int. Cl.[3] ..... B41F 17/28

[52] U.S. Cl. ..... 101/38 A; 101/115

[58] Field of Search ..... 101/115, 38 A, 38 R

[56] References Cited

U.S. PATENT DOCUMENTS

| | | | |
|---|---|---|---|
| 1,904,332 | 4/1933 | Sidebotham . | |
| 2,739,531 | 3/1956 | Hagerman . | |
| 2,885,957 | 5/1959 | Hansen | 101/115 X |
| 2,925,030 | 2/1960 | Johnson | 101/115 |
| 3,096,709 | 7/1963 | Eldred et al. | 101/115 |
| 3,110,247 | 11/1963 | Simpson . | |
| 3,390,757 | 7/1968 | Edwards et al. | 101/38 A X |

FOREIGN PATENT DOCUMENTS

| | | | |
|---|---|---|---|
| 2742245 | 3/1979 | Fed. Rep. of Germany | 101/115 |
| 55-28840 | 2/1980 | Japan | 101/38 A |
| 6612527 | 3/1967 | Netherlands | 101/115 |

*Primary Examiner*—Clifford D. Crowder

*Attorney, Agent, or Firm*—Lowe, King, Price & Becker

[57] ABSTRACT

In a known rotary type tapered part dichromatic printer having a first screen printer for a first printing at a first stop position of bottles which are clamped by pairs of clamping members equidistantly arranged on outer circumferences of a pair of rotary tables for synchronous intermittent rotation about the same axis and having a second screen printer for a second printing at a second stop position, a rotary type tapered part trichromatic printer is provided in which a third screen printer for a third printing to the tapered parts of bottles is disposed at a third stop position sequentially following said second stop position.

2 Claims, 31 Drawing Figures

94
86
110
85
83
96
F
8
11
102
98
101
145
97
61
105
100
99
103
106
126
132
144
92
91
124
125
107
127
88
134
149
141
142
143

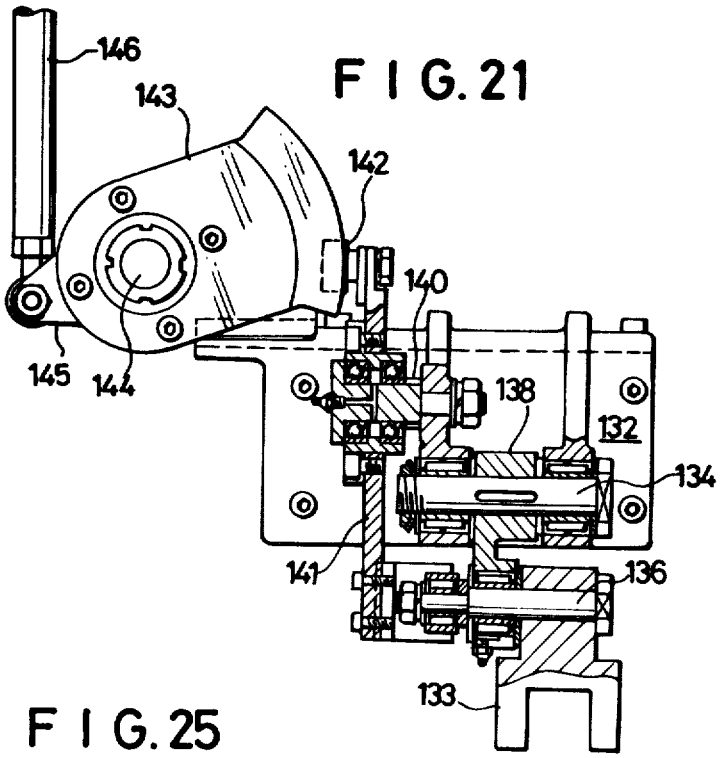
F I G. 21
F I G. 25
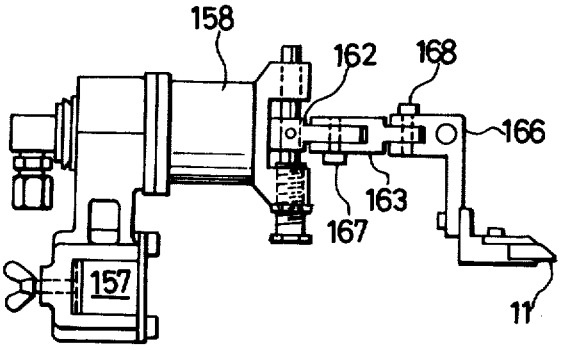

ROTARY TYPE TAPERED PART TRICHROMATIC PRINTER

BACKGROUND OF THE INVENTION (1) Field of the Invention

The present invention relates to a rotary type tapered part trichromatic printer which is capable of performing trichromatic printing on the tapered parts of materials to be printed such as round bottles.

(2) Description of the Prior Art

A rotary type tapered part dichromatic printer is known which incorporates a first screen printer at a first stop position of bottles which are clamped by pairs of clamping members equidistantly arranged on the outer circumferences of a pair of rotary tables coaxially arranged and synchronously intermittently rotating and sequentially intermittently displaced from the supply position to the releasing position, and a second screen printer for second printing at a next stop position of the bottles.

Trichromatic printing on the tapered parts of bottles has recently been required. For this purpose, the bottles to be printed are conventionally passed through the same printer twice, or they are sequentially passed through two printers, to accomplish the trichromatic printing. However, this disadvantageously results in inefficiency and is uneconomical.

SUMMARY OF THE INVENTION

It is the first object of the present invention to provide a printer which is capable of performing trichromatic printing on the tapered parts of materials to be printed such as round bottles, by passing them therethrough only once.

It is the second object of the present invention to provide a trichromatic printer which may be obtained by slight modification of a known rotary type tapered part dichromatic printer.

In a known rotary type tapered part dichromatic printer, a rotary type tapered part trichromatic printer according to the present invention is characterized in that, at a stop position sequentially following the stop position for the second printing, is disposed a third screen printer for the third printing on the tapered part of a material to be printed for operation synchronous with the first and second screen printers.

BRIEF DESCRIPTION OF THE DRAWINGS

FIG. 21 is a partial side view of the support operation device of the squeegee assembly 131 at the third printing position;

FIG. 25 is a partial front view of the squeegee assembly 131; and

DETAILED DESCRIPTION OF THE INVENTION

Figure 1:
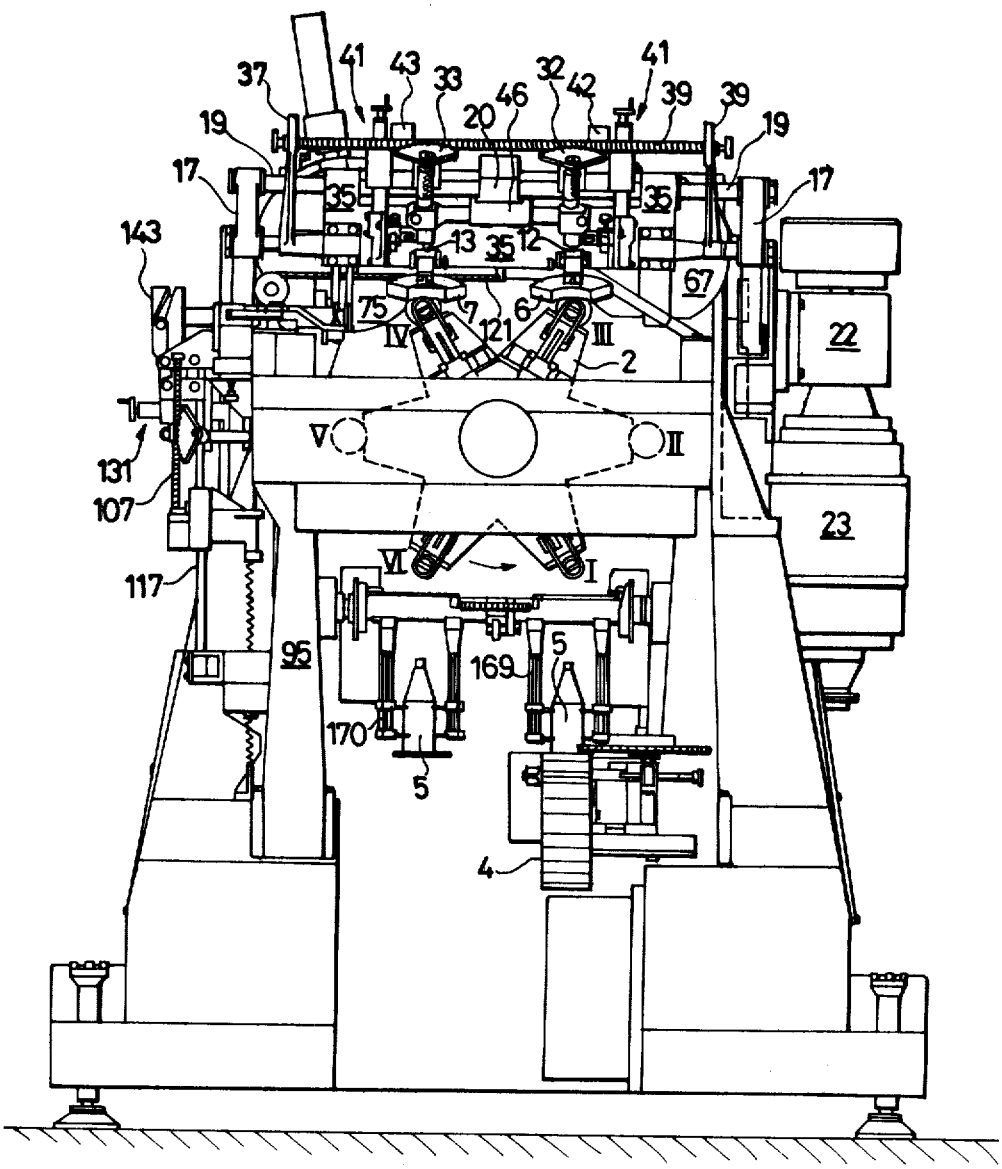
FIG. 1 is a front view showing an embodiment of the trichromatic printer for the tapered parts of bottles according to the present invention.
Figure 2:
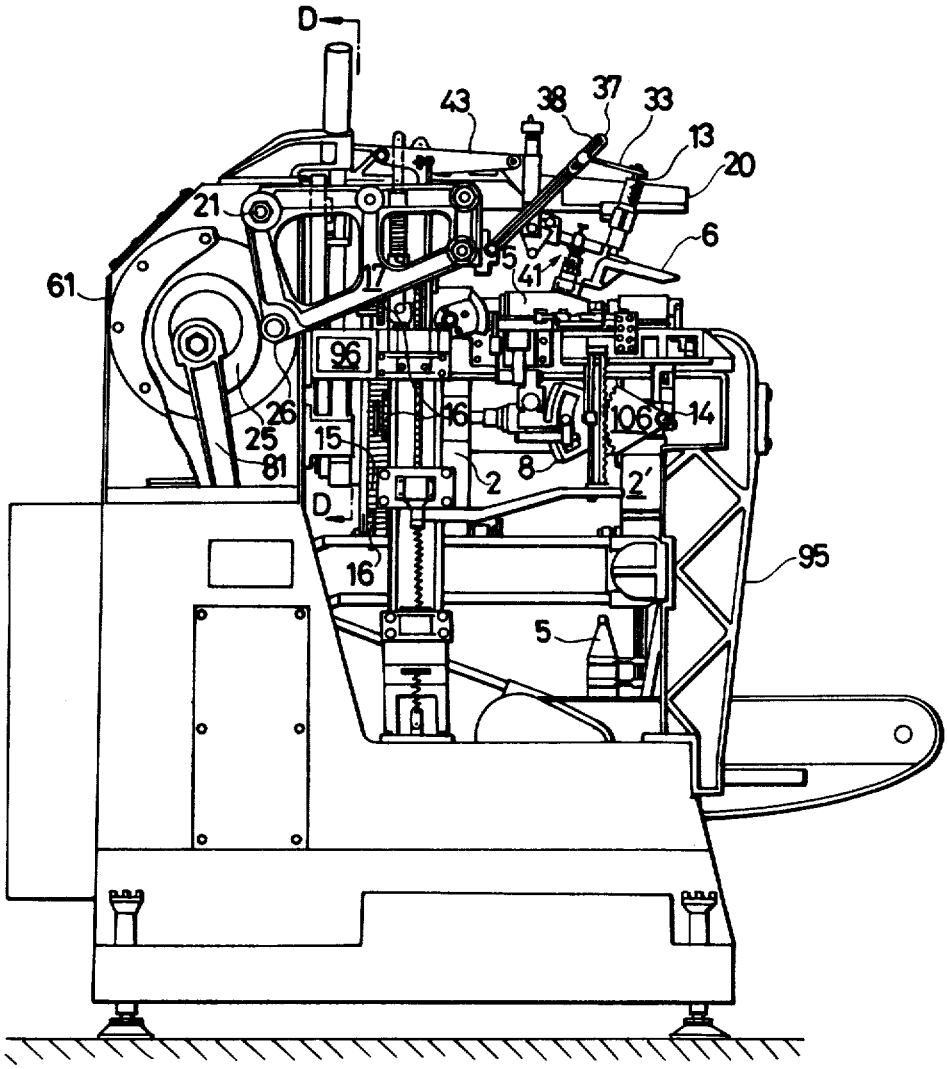
FIG. 2 is a left-side view thereof.

Referring to FIGS. 1 and 2, reference numerals 2, 2' are a pair of bottle clamping rotary tables which are supported by a shaft crossing the front and rear machine frames and which are intermittently rotated through 60° in the direction of the arrow. These bottle clamping rotary tables 2, 2', during the operation of the printer, automatically clamp at a stop position I (clamping position) bottles 5 which are to be printed and which are transported by a belt conveyer 4; intermittently and sequentially displace the bottles to a stop position II, a stop position III (a first printing position), a stop position IV (a second printing position), a stop position V (a third printing position), and a stop position VI (a releasing position); and automatically release the bottles onto a transporting device at the stop position VI. When the bottle clamping rotary tables 2, 2' are intermittently rotated and stop at the first to third printing positions III–V, a first screen 6, a second screen 7, and a third screen 8 advance to be in contact with the tapered parts of the bottles; a first squeegee 9, a second squeegee 10 and a third squeegee 11 advance; and the screens 6, 7 and 8 are rotated about their support shafts 12, 13 and 14 in synchronism with the printing rotation of the bottle for performing the required printing on the tapered circumferential surfaces of the bottles. After the printing operation, the screens and the squeegees are withdrawn from the bottles, and the bottles clamped by each pairs of clamping members disposed on the bottle clamping rotary tables 2, 2' are displaced to the next stop position by the intermittent rotational movement thereof. The bottles clamped by the bottle rotary tables 2, 2' are so clamped that they are rotated with planet gears 16 engaged with a sun gear 15 coaxially disposed behind the bottle clamping rotary table 2, and they are simultaneously rotated by the sun gear 15 during printing.

The support structure of the screens 6 and 7 at the first printing position III and the second printing position IV is as described below.

Figure 3:
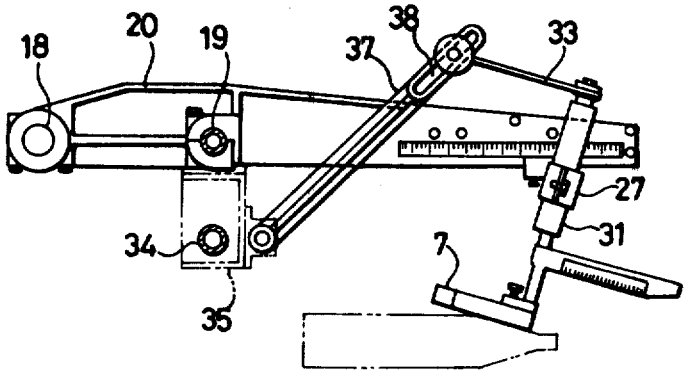
FIG. 3 is a left-side view showing the support structure of the screen at the second printing position of the trichromatic printer of the same.
Figure 3A:
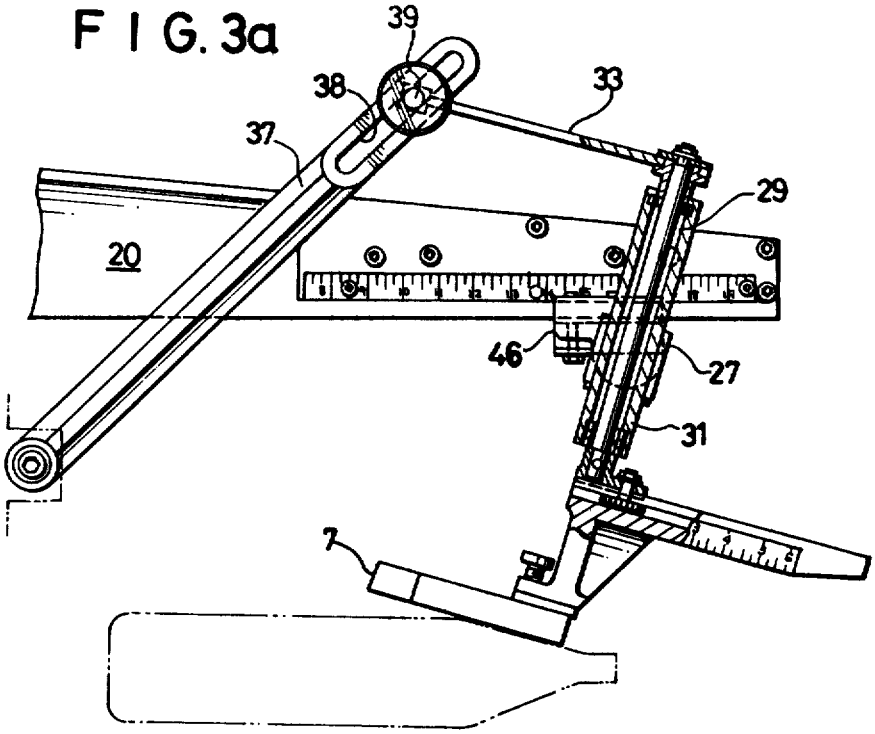
FIG. 3*a* is a partial enlarged view of FIG. 3.
Figure 4:
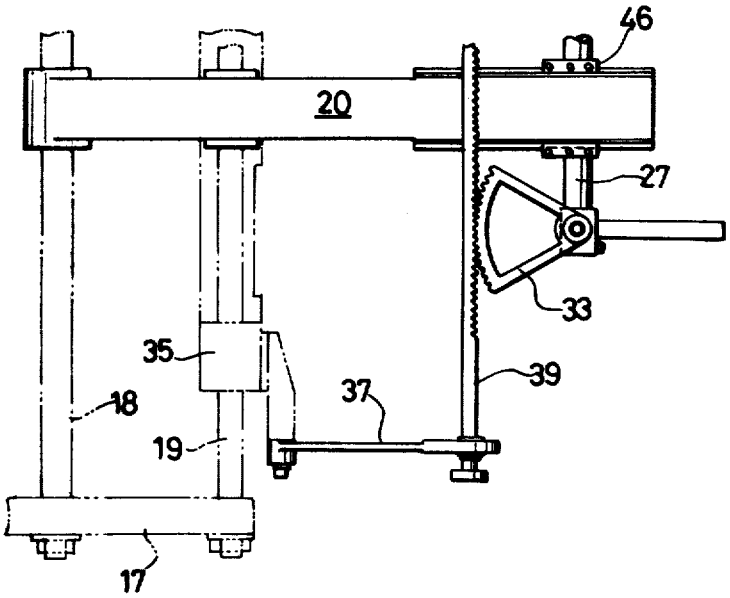
FIG. 4 is a partial top view showing the support mechanism of the screen of the same.
Figure 5:
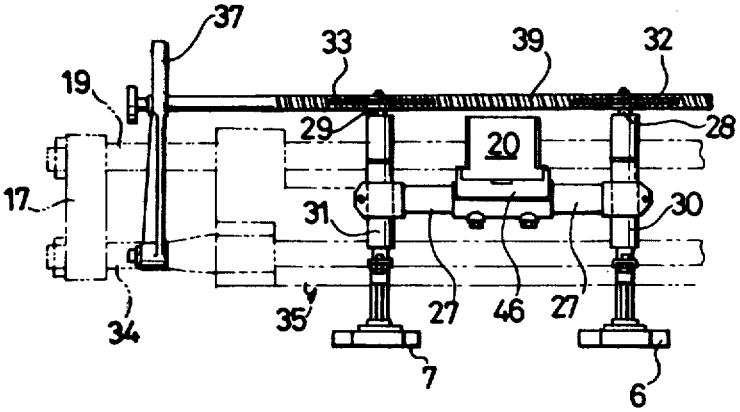
FIG. 5 is a partial front view showing the support structure of the screen of the same.
Figure 6:
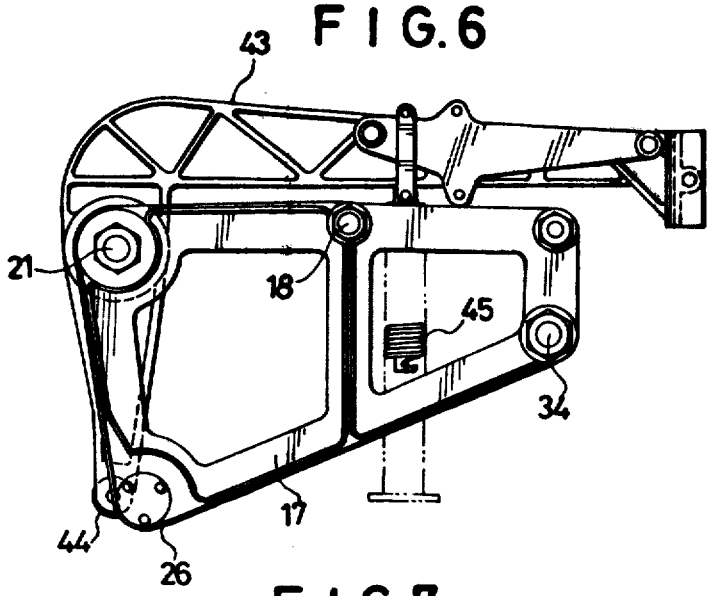
FIG. 6 is a left-side view showing the support structure of the squeegee assembly support frame at the second printing position.
Figure 7:
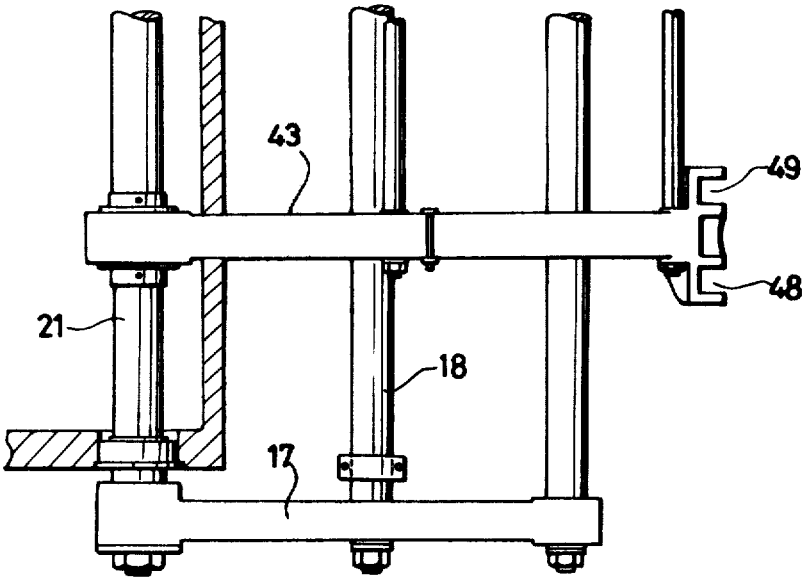
FIG. 7 is a partial top view showing the support mechanism of the same.
Figure 8:
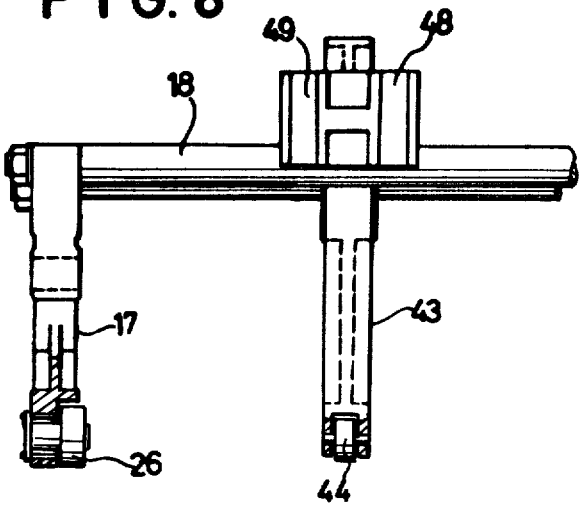
FIG. 8 is a partial front view showing the support mechanism of the same.
Figure 9:
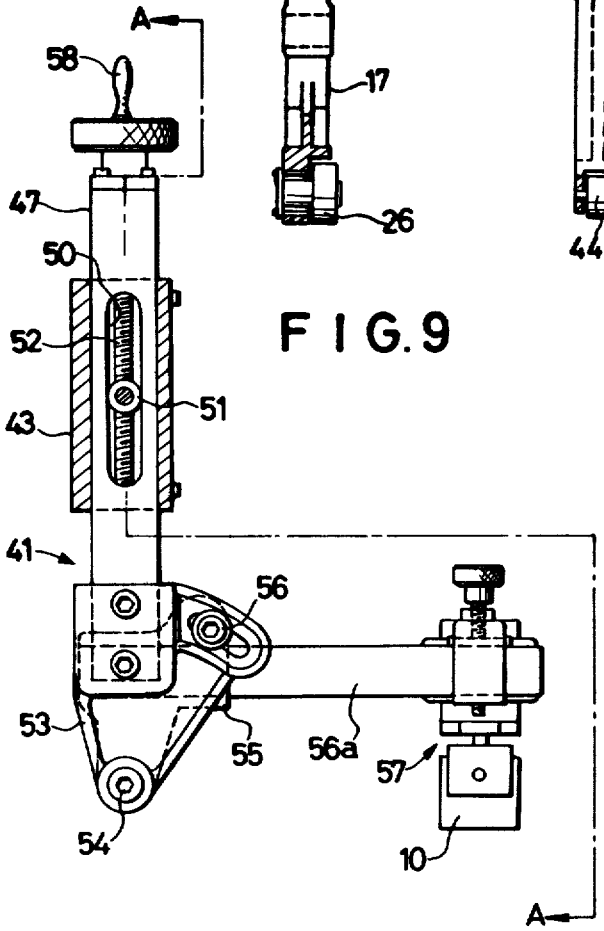
FIG. 9 is a partially sectional left-side view of the squeegee assembly at the second printing position.
Figure 10:
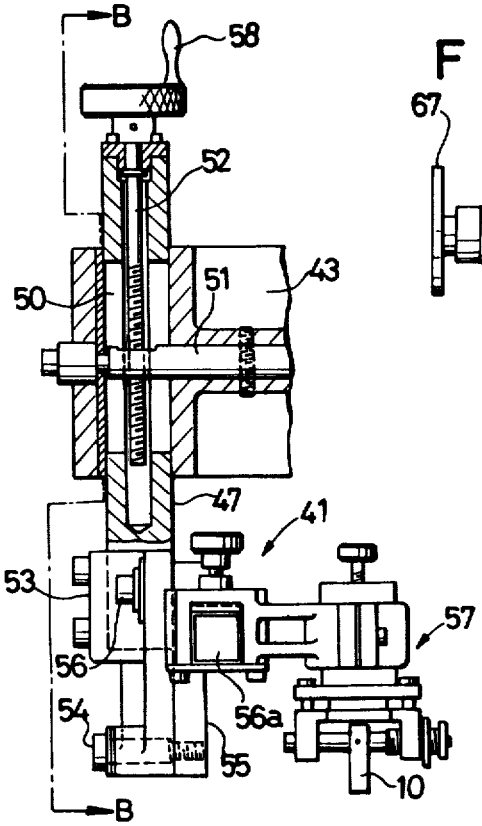
FIG. 10 is a partially sectional front view of the squeegee assembly of the same.

Referring to FIGS. 1 and 2, the first screen 6 and the second screen 7 are supported at the front part of a screen carriage 20 mounted at the central position between crossbars 18 and 19 crossing a pair of screen carriage support frames 17 which are pivotably mounted at the left and right ends of a horizontal shaft 21 horizontally arranged between the rear upper parts of the left and right machine frames (FIGS. 3 to 5). A cam roller 26 driven by a screen cam 25 is mounted to the lower rear ends of the screen carriage support frames 17. The screen cam 25 is mounted to a main spindle 24 rotatably crossing between the rear upper parts of the left and right machine frames, and the main spindle 24 is driven by an electric motor 23 through a reduction gear mechanism 22.

Referring to FIGS. 4 and 5, although the upper and right parts are cut away, they are symmetrical with the lower and left parts which are being illustrated. A support member 46 is mounted to the front pair of the rear surface of the screen carriage 20 such that its position may be adjustable in the front-to-back direction. A screen shaft support shaft 27 extending in the right-to-left direction is angularly adjustably mounted around the axial core of the support member 46. Bearing cylinders 30 and 31 for rotatably supporting two screen shafts 28 and 29 are mounted to the right and left ends of the shaft 27. The first screen 6 and second screen 7 are mounted to the lower ends of the screen shafts 28 and 29, and sector-shaped gears 32 and 33 are fixed to their upper ends.

Vertically spaced crossbars 19 and 34 cross between the front ends of the screen carriage support frames 17, and a horizontal right-to-left movable member 35 fits with the crossbars 19 and 34. Rack support rods 36 and 37 are mounted to the right and left ends of the horizontal right-to-left movable member 35 toward the upper front of the printer. The ends of a rack 39 are inserted inside elongated holes 38 formed at the upper parts of the rack support rods 36 and 37, in such a manner that their positions are adjustable in the longitudinal direction of the elongated holes 38. The rack 39 is engaged with the two sector-shaped gears 32 and 33. When the right-to-left movable member 35 is displaced in the right-to-left direction, the rack 39 is also displaced, so that the sector-shaped gears 32 and 33 are rotated clockwise or counterclockwise and the first screen 6 and the second screen 7 are rotated clockwise or counterclockwise.

The squeegee support structure at the first and second printing positions III and IV will now be described. The squeegee structures for the first printing positions III and the second printing position IV are of the same design (FIGS. 6–10).

Squeegee assemblies 40 and 41 supporting the squeegees at the first and second printing positions III and IV are mounted to the front ends of squeegee assembly support frames 42 and 43 pivotably mounted on the horizontal shaft 21 which is also pivotably supporting the screen carriage support frames 17, in such a manner that the positions of the squeegee assemblies 40 and 41 may be vertically adjusted. A cam roller 44 is mounted to the lower end of the rear depending part of the squeegee assembly support frame 43, and is pressed on the cam face on the main spindle 24 by a tension spring 45 the upper end of which is mounted to the horizontal part of the support frame 43.

The squeegee assembly 41 (FIGS. 6 to 10) is supported by the squeegee assembly support frame 43 by its arm rod 47 (having a rectangular sectional area) mounted to a front end support part 48 of the squeegee assembly support frame 43. A mounting part 49 of the squeegee assembly is for the body part of the bottle. An elongated through hole 50 is formed in the right-to-left direction of the arm rod 47, and a support rod 51 secured to the squeegee assembly support frame 43 is inserted through the elongated hole 50. A threaded rod 52 threadably inserted in the support rod 51 is rotatably disposed within the arm rod 47 in the axial direction thereof. This threaded rod 52 is mounted to the arm rod 47 so that it is not displaceable in the axial direction thereof. When the threaded rod 52 is rotated clockwise or counterclockwise by a handle 58, the arm rod 47 is vertically displaced relative to the squeegee assembly support frame 43. A mounting plate 53 is secured to the lower end of the arm rod 47, and an angle adjusting plate 55 is pivotably mounted to the mounting plate 53 by a pin 54. The angle adjusting plate 55 is secured to the mounting plate 53 by a set screw 56 threadably inserted in the angle adjusting plate 55 through the elongated hole of the mounting plate 53. One end of an arm **56*a* is fixed to the angle adjusting plate 55 and at the other end thereof is mounted a squeegee cylinder assembly 57 having the second squeegee 10 so that its positions may be adjusted in the longitudinal direction of the arm 56*a*. Since the squeegee cylinder assembly 57** is of a known construction, a detailed description thereof will be omitted.

Figure 13:
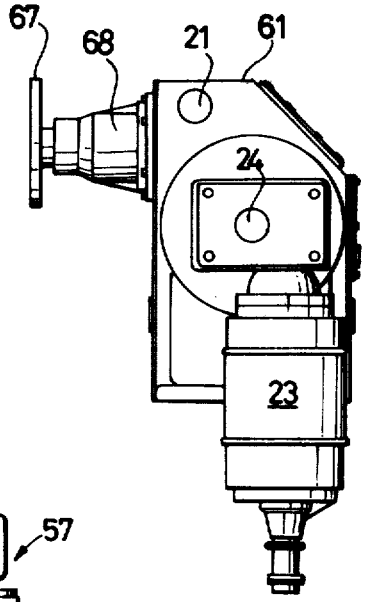
FIG. 13 is a partial right-side view of FIG. 11.
Figure 11:
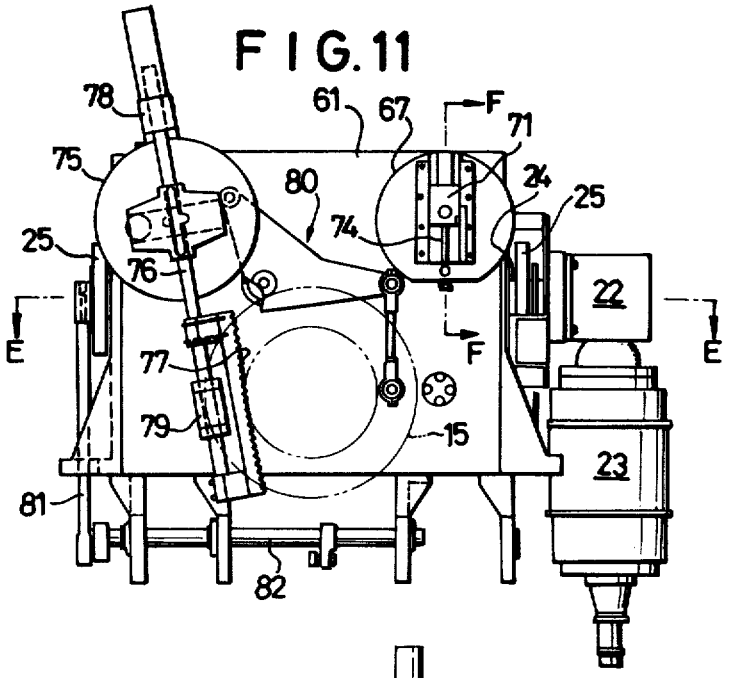
FIG. 11 is a partial front view of the gear box viewed along the direction of arrow from the line D—D of FIG. 2.
Figure 12:
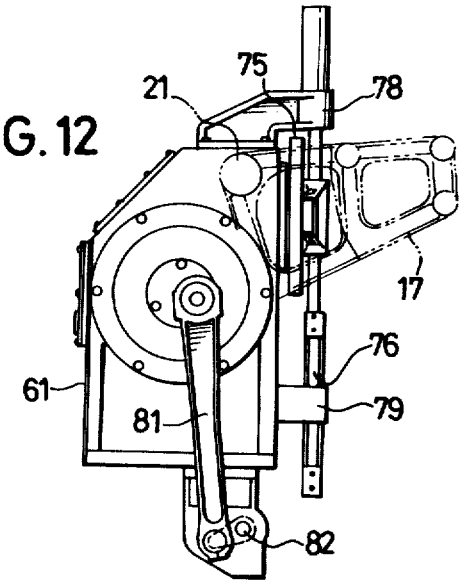
FIG. 12 is a partial left-side view of FIG. 11.

Referring to FIGS. 11 to 13, the main spindle 24 crosses through a gear box 61 and is driven by the electric motor 23 through the reduction gear 22. The screen carriage support frames 17 shown by the alternate long and short dashed lines are pivoted about the horizontal shaft 21 by the screen cam 25 secured to both ends of the main spindle 24. An Argason gear 62 for driving the bottle clamping rotary tables is secured at the central part of the main spindle 24 (FIG. 14) within the gear box 61. To the right of this are secured a squeegee cam 63 and a screen crank drive screw gear 64 and to the left are secured a squeegee cam 65 and a spindle crank drive screw gear 66.

Figure 15:
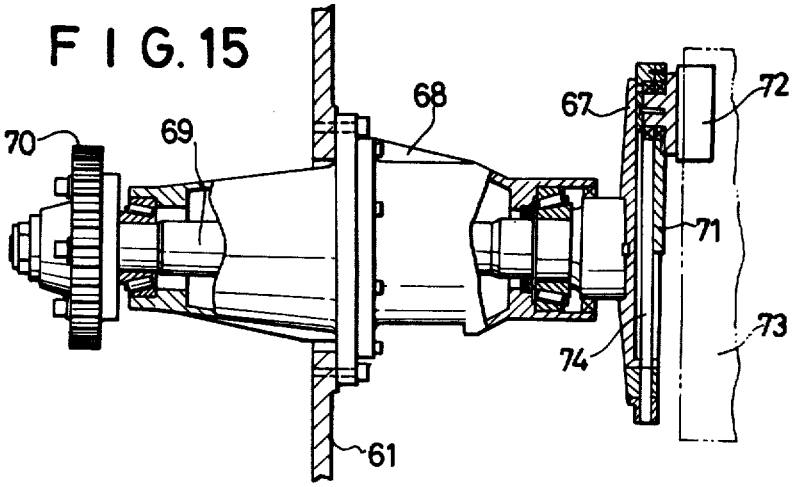
FIG. 15 is a vertical partially sectional, left-side view of the screen crank device.

A screen crank 67 (FIG. 15) is fixed to the front end of a screen crank shaft 69 received by a bearing box 68 mounted to the gear box 61. A screw gear 70 is secured to the rear end of the screen crank shaft 69, which engages with the screen crank drive screw gear 64 on the main spindle 24 and which is driven by the gear 64. A slide member 71 is mounted to the front surface of the screen crank 67 to be slidable in the direction of the diameter thereof, and a pivotable joint 72 is pivotably mounted to the front surface of the slide member 71. A groove is formed in the front surface of the pivotable joint 72. In this groove is slidably fitted a screen crank slide 73 projecting toward the rear from the right-to-left movable member 35 supported and guided by the crossbars 19 and 34 crossing between the screen carriage support frames 17. When the screen crank 67 is pivoted, the right-to-left movable member 35 is displaced so that the rack 39 is also displaced in the right-to-left direction. The slide member 71 disposed at the front surface of the screen crank 67 is slid in the radial direction of the screen crank 67 by an eccentricity adjusting screw rod 74 rotatably mounted to the screen crank 67.

A spindle crank 75 (FIGS. 11 and 12) is driven by the spindle crank drive screw gear 66 and vertically displaces a rack 77 secured to a slide rod 76 to rotate the sun gear 15 clockwise or counterclockwise and to rotate the bottles to be printed for printing. The slide rod 76 is supported and guided by bearings 78 and 79 mounted to the gear box 61. Reference numeral 80 in FIG. 11 denotes a bottle clamping member control mechanism of the bottle clamping rotary tables operated by the cam.

A vertically movable rod 81 eccentrically mounted to the left end of the main spindle 24 and vertically displaced with the rotation of the main spindle 24 rotates clockwise or counterclockwise a shaft 82 mounted in the right-to-left direction below the lower part of the gear box 61. By the clockwise or counterclockwise rotation of the shaft 82, the supply and transporting device of the bottle 5 to and from the bottle clamping rotary tables 2, 2' is controlled.

Figure 14:
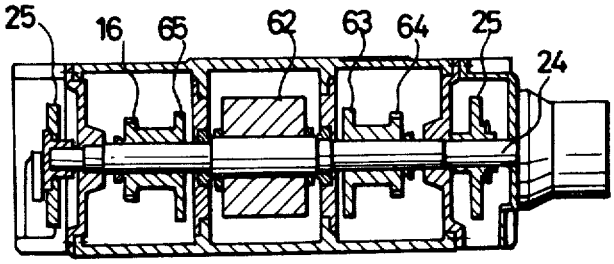
FIG. 14 is a horizontal sectional view of the gear box.

Since the construction described with reference to FIGS. 11 and 14 is known, a more detailed description thereof will be omitted.

The support structure of the screen at the third printing position V and the mode of operation thereof will now be described (FIGS. 1, 2, 16–18).

Figure 16A:
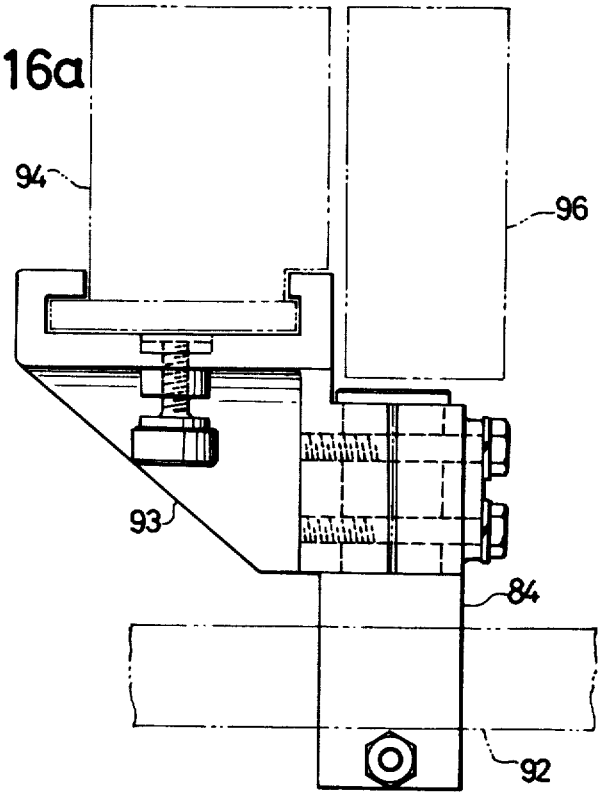
FIG. 16*a* is an enlarged view of the screen support part as viewed from the direction of arrow G of FIG. 16.
Figure 16:
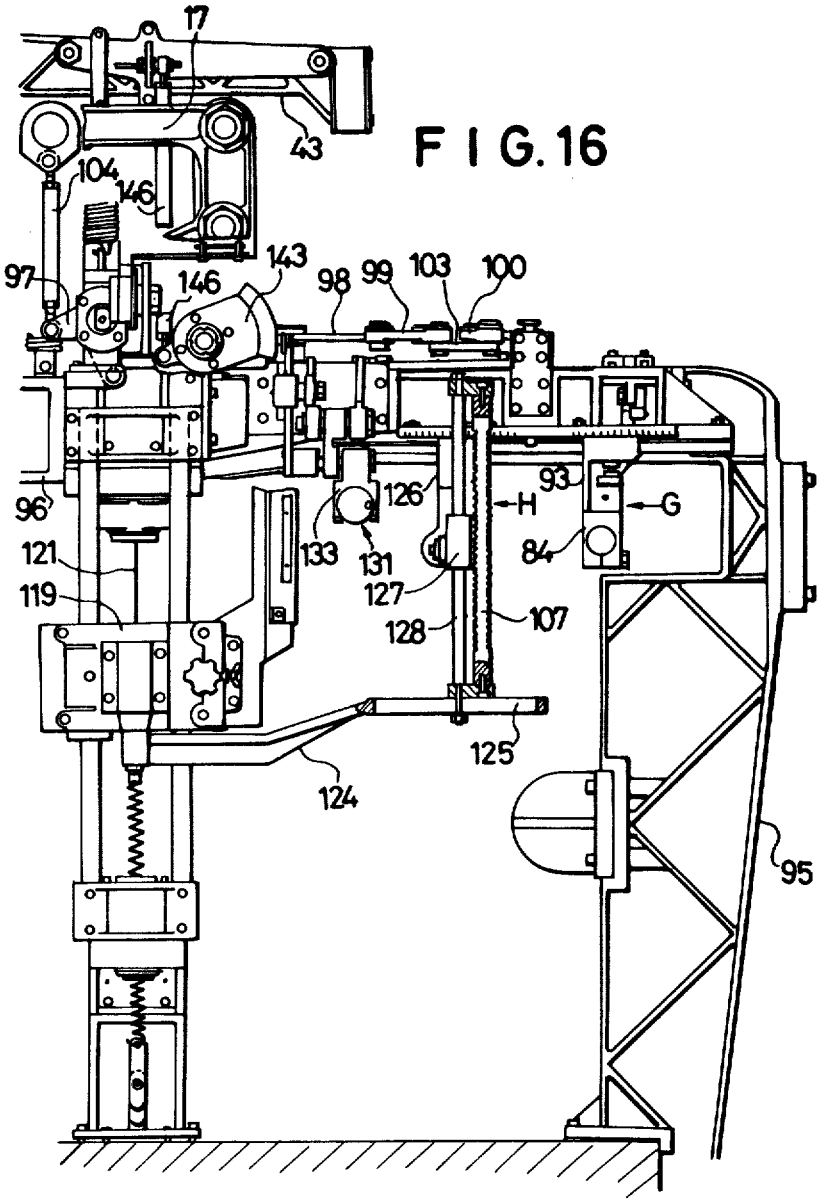
FIG. 16 is a partial enlarged side view showing the support operation structure of the screen and the squeegee at the third printing position.

A bearing cylinder 92 of a screen assembly 83 having the third screen 8 is mounted through a mounting piece 84 to a support piece 93 mounted along a pivotable girder 94 in such a manner that the position of the support piece 93 is adjustable (See particularly FIG. 16–1). A screen shaft 91 is rotatably supported by the bearing cylinder 92, and the screen 8 is fixed to the inner end. The mounting piece 84 is fitted within a vertical mounting hole of the support piece 93 and is mounted around its vertical axis such that its angle is adjustable. The bearing cylinder 92 of the screen assembly 83 is inserted in the mounting hole of the mounting piece 84 and is securely fixed to a predetermined position by a screw.

The pivotable girder 94 is pivotably mounted to the left of a stationary girder 96 supported by the front wall of the gear box 61 and a vertical frame 95 at the left front. Bell cranks 97, 98, 99 and 100 are arranged on the stationary girder 96 from its rear part toward the front part, and these bell cranks are so connected by connecting rods 101, 102 and 103 that they may be operated in cooperation with one another. The free end of the bell crank 97 is connected to the screen carriage support frame 17 by a connecting rod 104 and the free end of the bell crank 100 is connected to the pivotable girder 94 by a connecting rod 105. When the screen carriage support frame 17 is vertically displaced, the pivotable girder 94 pivots clockwise or counterclockwise by a link mechanism consisting of the bell cranks and the connecting rods described above, so the third screen 8 supported thereby is brought into contact with the tapered shoulder of the bottle at the printing position. A sector-shaped gear 106 is fixed to the outer end of the screen shaft 91, and a rack 107 engages with the sector-shaped gear 106.

Figures 17, 17A:
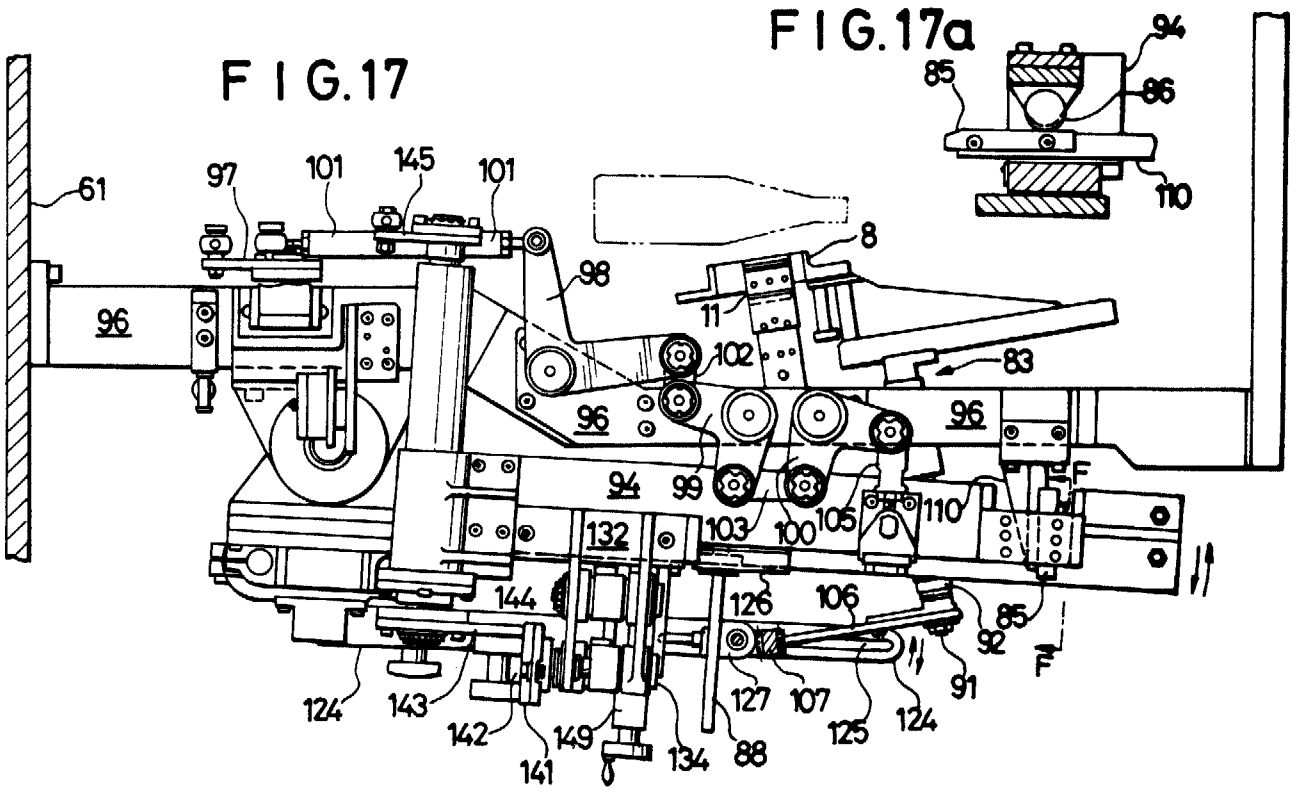
FIG. 17 is a top view showing the support operation structure of the screen and squeegee at the third printing position.
FIG. 17*a* is a sectional view along the line F—F of FIG. 17.
Figure 19:
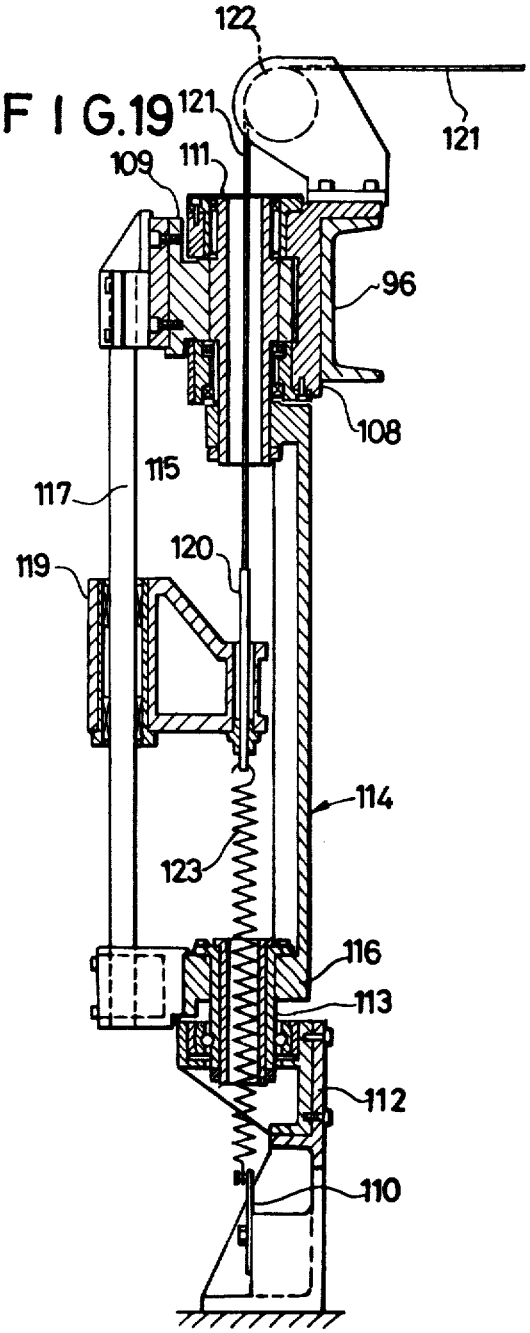
FIG. 19 is a vertical partially sectional, front view showing the table mounting structure of the pivotable girder and the rack support arm.
Figure 22:
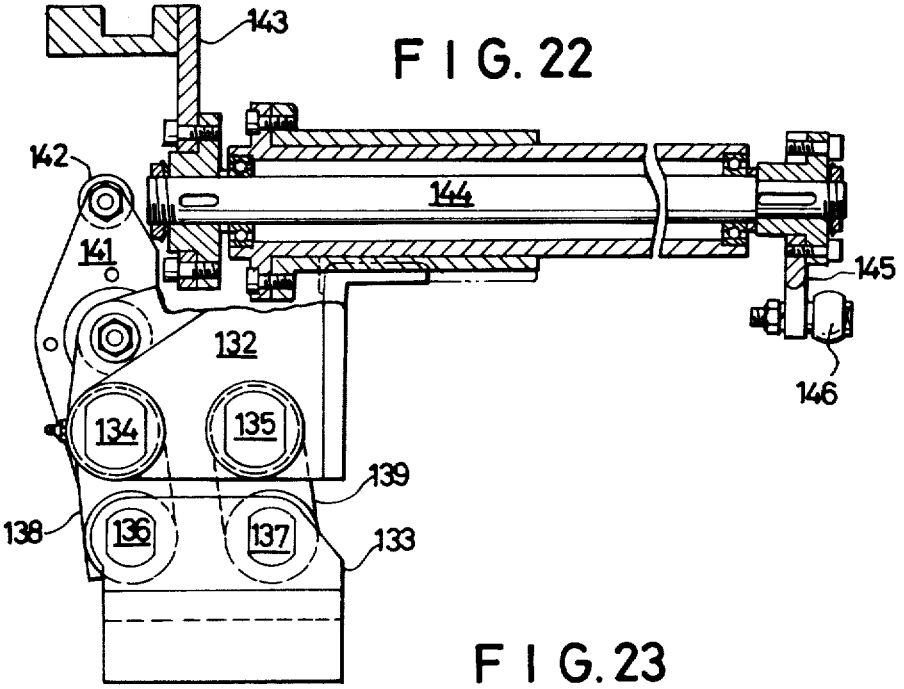
FIG. 22 is a partial front view of the support operation device of the squeegee assembly 131 of the same.

The pivotable girder 94 (FIG. 19) is, at its rear end, fixed to a pivotable piece 109 pivotably mounted to a bearing piece 108 which is in turn fixed near the rear end of the stationary girder 96. The front end of the pivotable girder 94 is supported by a support piece 110 disposed in the proximity of the front end of the stationary girder 96 so that the pivotable girder 94 may be displaced in the right-to-left direction on the support piece 110 (FIG. 17). FIG. 17*a* is a sectional view along the line F—F of FIG. 17, and illustrates the support structure of the front end of the pivotable girder 94. In this figure, reference numeral 85 denotes a support rail and 86 denotes a support roller. The pivotable piece 109 is pivotably mounted to the bearing piece 108 by a vertical hollow shaft 111 fitted with the pivotable piece 109 in such a manner that it is not pivotable. A hollow shaft 113 is pivotably mounted immediately below the hollow shaft 111 as supported by a bearing piece 112 mounted to the table frame. The hollow shafts 111 and 113 are on the same vertical axis. Fitting parts 115 and 116 are mounted to the upper and lower ends of a coupling member 114 of recessed sectional area and connecting the hollow shafts 111 and 113, and the fitting parts 115 and 116 are fitted outside of the hollow shafts 111 and 113 respectively, such that they are not pivotable. A pair of guide rods 117 and 118 are mounted through mounting plates between the lower fitting part 116 and the upper pivotable piece 109. The guide rods 117 and 118 are parallel to the axis of the hollow shafts 111 and 113. A slide piece 119 is slidably mounted to the guide rods 117 and 118. A chain mounting rod 120 is mounted to the slide piece 119 as substantially located on the axis of the hollow shafts 111 and 113. The lower end of a chain 121 depending downwardly through a hole in the hollow shaft 111 is mounted to the upper end of the chain mounting rod 120. The other end of the chain 121 is mounted to the chain mounting piece of the right-to-left movable member 35 (FIG. 1). The chain 121 changes its direction by a chain wheel 122. The upper end of a tension spring 123, the lower end of which is mounted to the support piece 110, is mounted to the lower end of the chain mounting rod 120. Therefore, the slide piece 119 is smoothly vertically displaced along the slide guide rods 117 and 118 with the lateral movement of the right-to-left movable member 35.

Figure 16B:
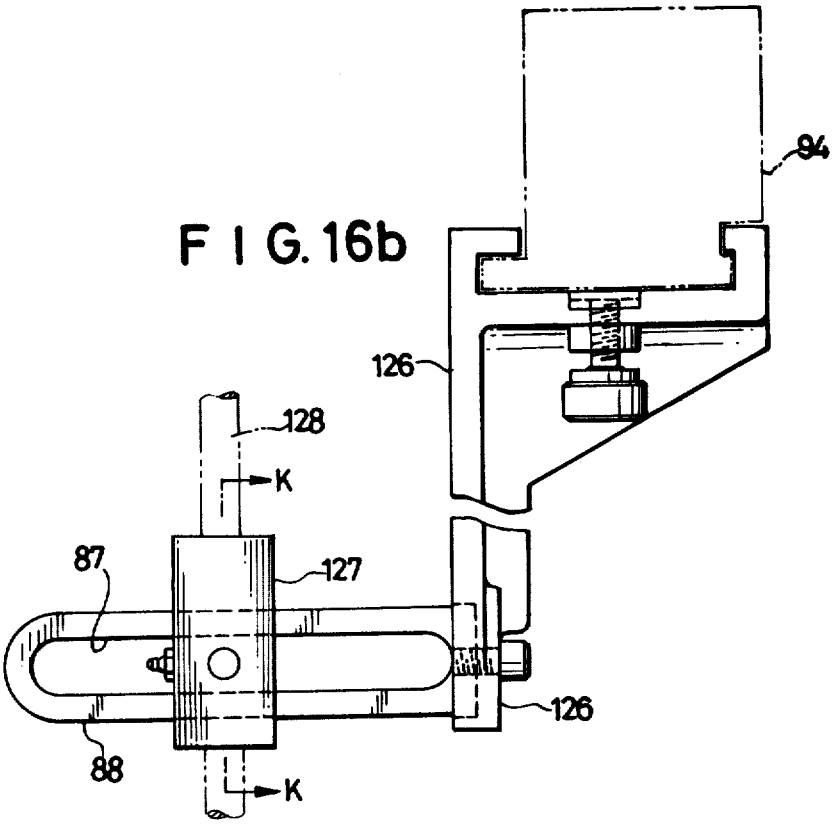
FIG. 16*b* is an enlarged view of the rack support part as viewed from the direction of arrow H in FIG. 16.
Figure 16C:
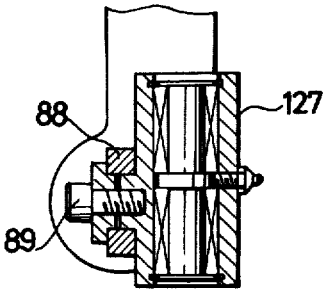
FIG. 16*c* is a sectional view along the line K—K of FIG. 16*b*.

To the slide piece 119 is securely fixed a rack support arm 124 extending toward the front therefrom (FIGS. 16 and 17). An elongated hole 125 is formed at the front part of the rack support arm 124. FIG. 16*b* shows the support guide assembly of a rack support rod 128 with the rack 107 being cut away as viewed from the direction H of FIG. 16. The support guide assembly has a mounting piece 126 fixed to the pivotable girder 94 in such a manner that its position is adjustable in its axial direction; a support rod 88 fixed to the mounting piece 126 and having an outwardly extending elongated hole 87; and a bearing 127 fixed on the support rod 88 in such a manner that its position is adjustable along the elongated hole 87. The bearing 127 is secured to a desired position of the support rod 88 by tightening a screw 89. The rack support rod 128 vertically slidably fits with the bearing 127. The lower end of the rack support rod 128 is fitted in the elongated hole 125 and fixed to the rack support arm 124 with a nut. Rack mounting pieces are secured to the rack support rod 128 at the upper and lower ends thereof. The rack 107 is mounted between the rack mounting pieces, and has teeth at its front and rear parts, as in FIG. 16. Thus, when the teeth at one side become abraded, the teeth at the other side may then be used.

With this construction, when the pivotable girder 94 is pivoted about the axis of the hollow shaft 111, the rack support arm 124 also pivots about the same axis so that the relative positions of the rack 107 and the sector-shaped gear 106 do not change at all when the pivotable girder 94 is pivoted.

A third squeegee assembly 131 having the third squeegee 11 (FIGS. 16 to 18, 21 and 22) is fixed to a holding piece 133 which is in turn mounted on a support piece 132 secured to the pivotable girder 94 such that the holding piece 133 may be movable in the right-to-left direction. The holding piece 133 is mounted to the support piece 132 in such a manner that it may be displaced in the right-to-left direction by a parallel four-rod link consisting of shafts 134 and 135 mounted to the support piece 132 spaced apart from each other; shafts 136 and 137 mounted to the upper part of the support piece 132 spaced apart from each other; a link 138 connecting the shafts 134 and 136; and a link 139 connecting the shafts 135 and 137. The third squeegee assembly 131 is movable toward and away from the bottle to be printed while maintaining its horizontal condition. The groove at the lower end of a lever 141 pivotably mounted to the shaft 140 mounted to the support piece 132 is fitted to the rear projecting end of the shaft 136. A cam roller 142 is mounted to the upper end of the lever 141, and the cam roller 142 is fitted inside the cam groove of a cam 143. The cam 143 is fixed to the left end of a shaft 144 pivotably mounted on the pivotable girder 94. One end of a link lever 145 is fixed to the right end of the shaft 144 and the other end of the link lever 145 is connected to the squeegee assembly support frame 43 by a connecting rod 146. Therefore, when the squeegee assembly support frame 43 is pivoted, the third squeegee assembly 131 is correspondingly displaced in the right-to-left direction.

Figure 18:
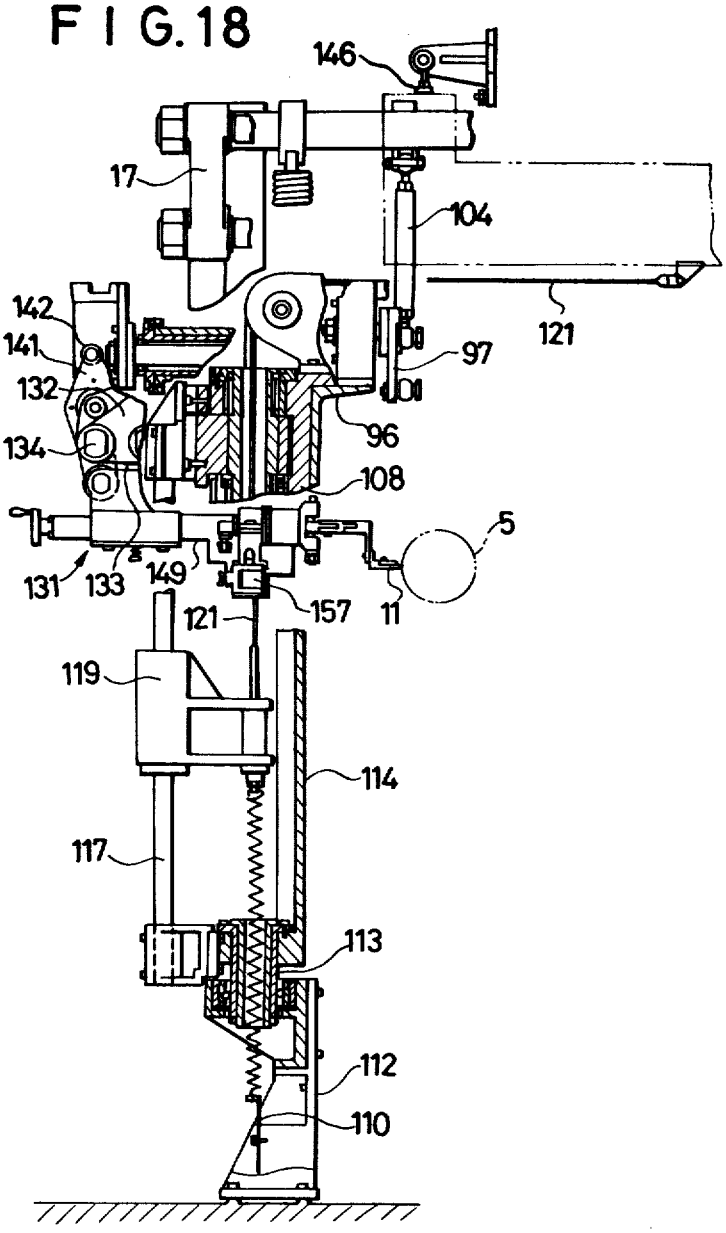
FIG. 18 is a view showing the structure of the support operation related parts of the screen and the squeegee at the third printing position.
Figure 20:
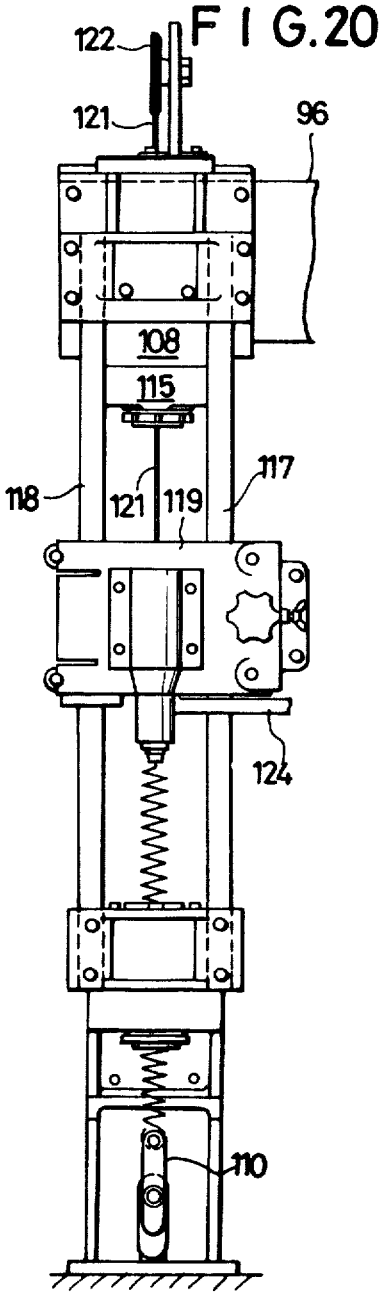
FIG. 20 is a left-side view showing the mounting condition of the pivotable girder and the rack support arm to the table part.
Figure 23:
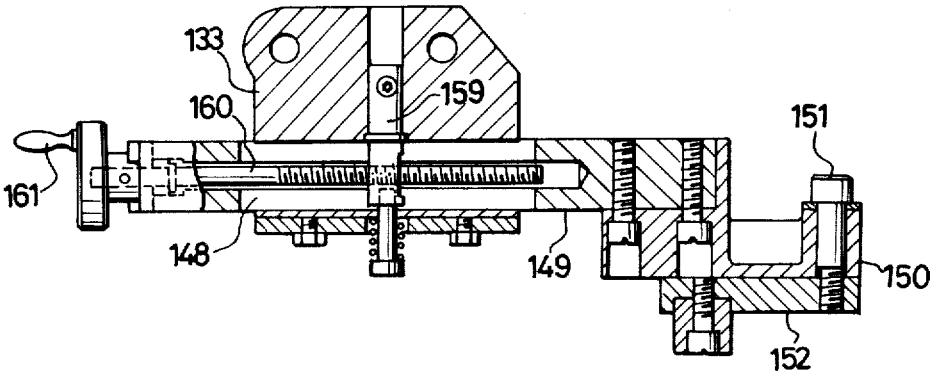
FIG. 23 is a vertical sectional view showing the rod arm 149 of the squeegee assembly 131 and its holding structure.
Figure 24:
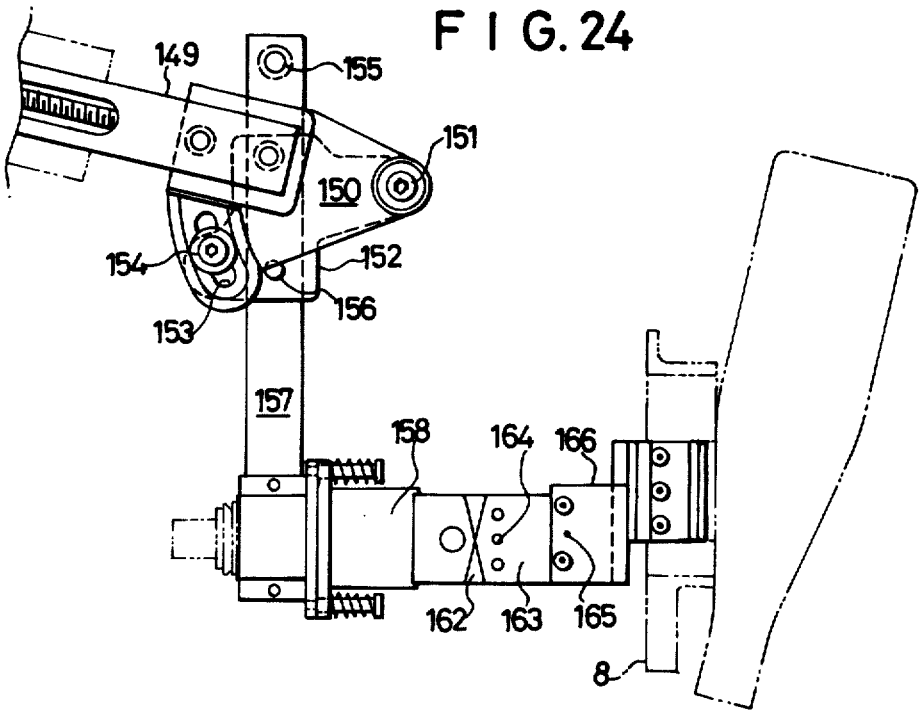
FIG. 24 is a partial plan view of the squeegee assembly 131.

The structure of the third squeegee assembly 131 will now be described (FIGS. 18 and 23 to 25). The third squeegee assembly 131 has an arm rod 149 of square sectional area slidably mounted to the holding piece 133 (FIGS. 18, 23 and 24). The arm rod 149 is of a construction the same as that of the arm rod 47. Thus, a support rod 159 secured to the holding piece 133 is fitted in an elongated hole 148 formed in the vertical direction, and a threaded rod 160 pivotably mounted to the arm rod 149 in the longitudinal direction thereof threadably engages inside the support rod 159. When the threaded rod 160 is pivoted clockwise or counterclockwise by a handle 161, the arm rod 149 is displaced in the right-to-left direction relative to the holding piece 133. A mounting plate 150 is secured to the right end of the arm rod 149 (FIG. 24), and a squeegee angle adjusting plate 152 is mounted to the rear surface of the mounting plate 150 by a pin 151. The angle adjusting plate 152 is fixed to the mounting plate 150 by a set screw 154 screwed into the angle adjusting plate 152 through an elongated hole 153 in the mounting plate 150. One end of an arm 157 is fixed to the rear surface of the angle adjusting plate 152 with screws 155 and 156. A squeegee cylinder 158 is securely fixed to the other end of the arm 157. Since the squeegee cylinder 158 is of a known construction, a detailed description thereof will be omitted. A vertically movable plate 162 is mounted to the squeegee cylinder 158 in such a manner that its position may be vertically adjustable. A front-to-back movable plate 163 pivotable about a pin 164 in the front-to-back direction for angular adjustment is mounted to the vertically movable plate 162. A holding body 166 of the squeegee 11 which may be pivoted about a pin 165 for angular adjustment is mounted to the front-to-back movable plate 163. The vertically movable plate 162 and the front-to-back movable plate 163 are fixed to form a certain angle by a clamping screw 167, and the front-to-back plate 163 and the holding body 166 are fixed to form a certain angle by a clamping screw 168.

The position of the third squeegee 11 may be adjusted vertically and in the right-to-left direction, and the angle thereof may be adjusted so as to match with the angle of the shoulder part of various types of bottles.

The structure of the support mechanism, for supporting the third squeegee 11 so as to be movable vertically and in the right-to-left direction and angularly adjustable relative to the bottle to be printed, may be modified in various ways within the scope of its original purpose.

Figure 26:
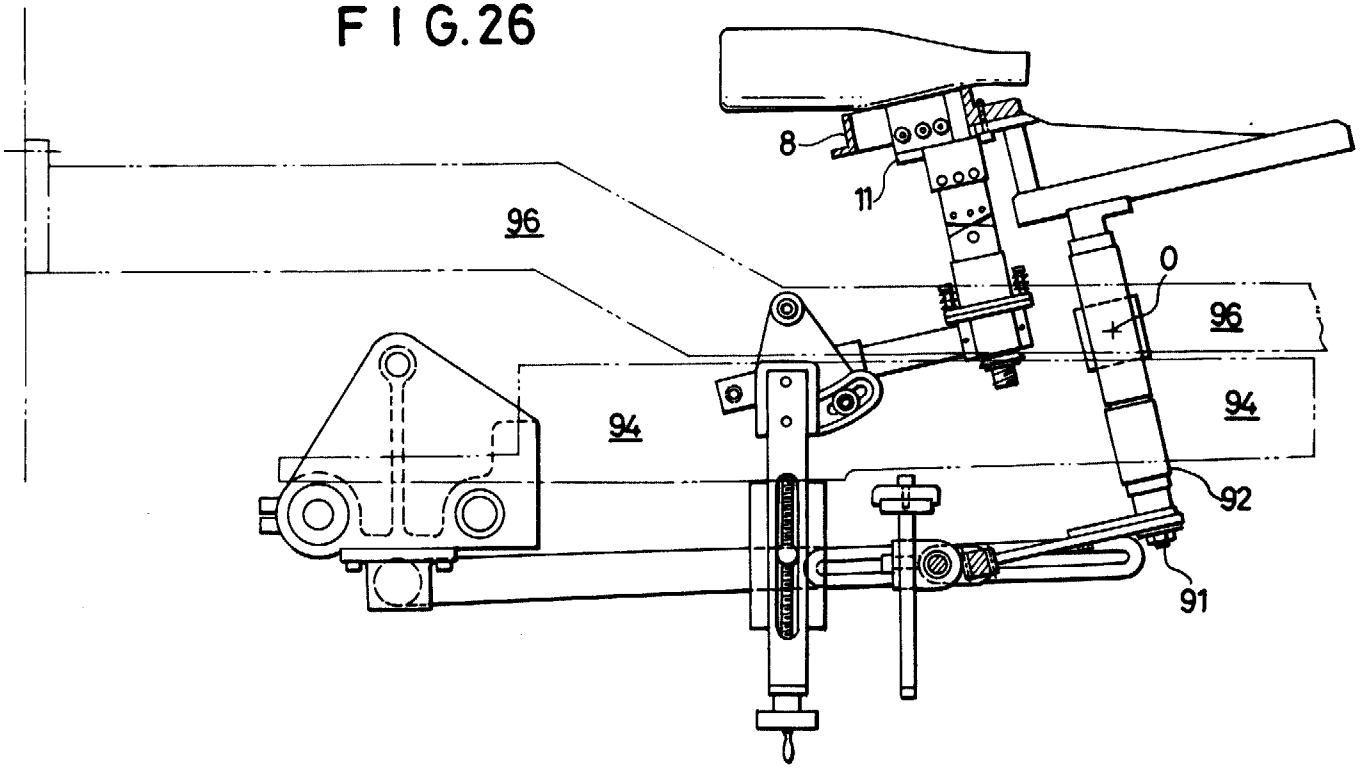
FIG. 26 is a plan view showing the arrangement of the third screen and the third squeegee 11.

FIG. 26 is a plan view illustrating the relation among the third screen, the third squeegee 11, the pivotable girder 94, the stationary girder 96, and so on. The bearing cylinder 92 for supporting the screen shaft 91 of the third screen 8 is supported by the pivotable girder 94 and is fixed at a desired angle after angular adjustment about a point 0.

The mode of operation of the embodiment shown in the drawings will now be described. When the bottle clamping rotary tables 2, 2' are stopped during the operation of the printer, at the stop position I, the bottle 5 is carried between a pair of bottle clamping members of the bottle clamping rotary tables 2, 2' from the supply belt conveyer 4 by a transporting member 169 to be clamped by the bottle clamping rotary tables 2, 2'. The bottle to be printed and clamped between the clamping members is rotated at the stop position II and the printing position is determined. At the stop position III, the stop position IV, and the stop position V, the screens 6, 7 and 8 are simultaneously advanced from their withdrawn positions to the printing positions at which they are in contact with the tapered shoulders of the bottles to be printed. The screens 6, 7 and 8 are then rotated about their support axes at a speed so as not to cause slippage with the tapered shoulder surfaces of the bottles to be printed, simultaneously with the synchronous rotation for printing of the bottles to be printed, by the sun gear. During this operation, the squeegees 9, 10 and 11 are in contact with the screens 6, 7 and 8. Following this, the screens 6, 7 and 8, and the squeegees 9, 10 and 11 are simultaneously withdrawn from the bottles to be printed. The squeegees 9, 10, 11 are spaced apart from their respective screens 6, 7 and 8. At the sixth stop position VI, the bottle clamped between the bottle clamping members is released and is transported on a collecting belt conveyer by a transporting member 170.

In summary, in a rotary type tapered-part printer in which clamping members for clamping the materials to be printed are rotatably supported on intermittently rotating rotary tables and which incorporates screen printers such that they are capable of movement toward and from materials to be printed, said screen printers having squeegees and screens that rotate about axes obliquely crossing the rotational axes of the clamping members at the respective printing positions, the present invention provides a rotary type tapered part trichromatic printer which is characterized in that said screen printers are arranged at three positions on the same circumference and are connected by a link mechanism so that said movement of the third screen printer toward and from the material to be printed may be simultaneously performed with said movement of the second screen printer toward and away from the materials to be printed. Accordingly, the trichromatic printing for the tapered part of a bottle or the like may be accomplished by one rotation within a rotary type printer. Furthermore, the printer of the present invention may be manufactured by slightly modifying the conventional dichromatic printer by connecting the third screen printer to the first and second screen printers with a cooperation mechanism, resulting in greater economy.

What is claimed is:

1. A rotary type tapered part trichromatic printer apparatus, comprising:

(a) a pair of rotary tables having a predetermined distance therebetween and being operatively arranged for synchronous intermittent rotation about a substantially horizontal core;

(b) clamping means circumferentially and operatively arranged in relation to the horizontal axial core for clamping materials for printing;

(c) first and second screen printers respectively located to define first and second printing stop stations within substantially the same horizontal plane above said horizontal axial core of said rotary tables;

(d) a third screen printer located to define a third printing stop station for printing materials in substantially the same horizontal plane as said horizontal axial core, said third screen printer including a screen and a squeegee;

(e) a pivotal member secured to a machine frame of the apparatus, said pivotal member carrying the screen and the squeegee and being pivotable to move the screen and the squeegee in a front to back direction, a left to right direction, a vertical direction and along the direction of a tapered part of said materials to be printed;

(f) a screen carriage support frame operatively connected to the pivotal member with connecting rod means and being movable to pivot said pivotal member in a direction causing the screen to move into and out of a printing position;

(g) a linkage mechanism operatively connected to the pivotal member for moving the squeegee of the third screen printer relative to the pivotal member in cooperating with first and second squeegees respectively located within the first and second screen members; and (h) a transverse movable member operatively connected to pivot the third screen in cooperation with the pivotal member, causing synchronous rotation of the first and second screens.

2. A rotary type tapered part trichromatic printer according to claim 1 wherein said screen of said third screen printer is pivoted by a rack which is in turn vertically displaced in cooperation with said transverse movable member.

* * * * *